US009216127B1

(12) United States Patent
Cox et al.

(10) Patent No.: US 9,216,127 B1
(45) **Date of Patent: *Dec. 22, 2015**

(54) BURIAL VAULT AND METHOD FOR CUSTOMIZING A BURIAL VAULT

(71) Applicants: Christie Marie Cox, Polo, IL (US); Marty Jay Cox, Polo, IL (US)

(72) Inventors: Christie Marie Cox, Polo, IL (US); Marty Jay Cox, Polo, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/543,484

(22) Filed: Nov. 17, 2014

Related U.S. Application Data

(63) Continuation-in-part of application No. 14/017,018, filed on Sep. 3, 2013, now Pat. No. 8,887,358, which is a continuation-in-part of application No. 10/775,746, filed on Feb. 10, 2004, now abandoned.

(60) Provisional application No. 60/447,467, filed on Feb. 14, 2003.

(51) Int. Cl.

| | |
|---|---|
| ***A61G 17/04*** | (2006.01) |
| ***A61G 99/00*** | (2006.01) |
| ***E04H 13/00*** | (2006.01) |

(52) U.S. Cl.
CPC ..... *A61G 17/04* (2013.01); *A61G 99/00* (2013.01); *E04H 13/00* (2013.01); *A61G 2017/042* (2013.01)

(58) Field of Classification Search
CPC ..... E04H 13/00; E04H 13/001; A61G 17/04; A61G 17/08; A61G 2017/042; G09F 3/10; G09F 7/12; B32B 7/12; B32B 9/00; B44C 5/00
USPC ..... 27/1, 2, 19, 35; 52/128, 139; 40/638, 40/594; 428/42.3
See application file for complete search history.

(56) References Cited

U.S. PATENT DOCUMENTS

| | | | | |
|---|---|---|---|---|
| 4,219,596 | A | 8/1980 | Takemoto et al. | |
| 5,209,959 | A | 5/1993 | McNaul et al. | |
| 5,225,260 | A | 7/1993 | McNaul et al. | |
| 6,223,404 | B1 | 5/2001 | Fant et al. | |
| 6,410,111 | B1 * | 6/2002 | Roth et al. | 428/40.1 |
| 6,586,510 | B1 | 7/2003 | Brown et al. | |
| 7,093,396 | B2 | 8/2006 | Pazar | |
| 7,222,400 | B2 | 5/2007 | Leverett | |
| 7,592,057 | B2 * | 9/2009 | Dronzek et al. | 428/40.1 |
| 2002/0023325 | A1 * | 2/2002 | Fant et al. | 27/2 |
| 2005/0170128 | A1 * | 8/2005 | Lai | 428/42.3 |
| 2009/0295142 | A1 | 12/2009 | Maule et al. | |
| 2013/0117977 | A1 | 5/2013 | Kennedy | |

* cited by examiner

*Primary Examiner* — William Miller
(74) *Attorney, Agent, or Firm* — Drinker Biddle & Reath LLP

(57) ABSTRACT

A decorative burial vault includes a decorative top surface substrate having a decorative graphic thereon, the substrate being attached to the top surface of the burial vault or a carapace attached to the burial vault.

5 Claims, 5 Drawing Sheets

BURIAL VAULT AND METHOD FOR CUSTOMIZING A BURIAL VAULT

CROSS REFERENCE TO RELATED APPLICATIONS

This Application is a continuation-in-part application of U.S. patent application Ser. No. 14/017,018 filed Sep. 3, 2013, entitled "BURIAL VAULT CARAPACE AND METHOD FOR CUSTOMIZING A BURIAL VAULT CARAPACE", which is U.S. Pat. No. 8,887,358, which is a continuation-in-part application of U.S. patent application Ser. No. 10/775,746 filed Feb. 10, 2004, entitled "METHOD FOR CUSTOMIZING A BURIAL VAULT CARAPACE", which claims the benefit of U.S. Provisional Application Ser. No. 60/447,467 filed Feb. 14, 2003, entitled "METHOD FOR CUSTOMIZING A BURIAL VAULT CARAPACE", the contents of all being incorporated herein by reference.

FIELD

Disclosed herein is a burial vault having a customized decorative external surface. The invention more particularly relates to a method for customizing the surface of the burial vault.

SUMMARY

A decorative overlay for a burial vault is provided and a method for decorating the same. A decorative burial vault includes a top surface possibly having a carapace on the a top surface; and a substrate having a decorative graphic, the substrate being attached to a top surface of the carapace. According to one embodiment, the substrate is adhered to the burial vault or carapace using adhesive.

The substrate may be largely transparent, which allows the carapace to show through in areas that are not covered by the decorative graphic, or when the coloring of the decorative graphic is transparent. This is desirable when the carapace is made of a high quality material, such as stainless steel, copper, or bronze. However, it is also possible to utilize an opaque substrate as well, such as a solid white or solid black substrate. This is desirable when the substrate is applied directly to the burial vault surface, which would typically be a concrete surface, or to a carapace surface of a low quality material.

Moreover, the decorative graphic may be printed on the substrate. The substrate may be formed from a material selected from the group of polyester, polypropylene, polyethylene, vinyl, acetate, acrylic, polystyrene, or polycarbonate. These materials are desirable based on various characteristics, such as transparency, ease of printing, cost, and ease of application. However, the embodiments disclosed herein are not limited to these materials, and can incorporate any material to which decorative graphic images can be applied. This could include, but is not limited to, paper, cardboard, wood (and synthetics), glass, and metal.

According to yet another embodiment of the invention the substrate is adhered to the carapace using transparent adhesive. A related embodiment includes a decorative funeral urn having an exterior surface; and a substrate having a decorative graphic, the substrate being attached to the exterior surface of the urn. According to one embodiment of the invention, the substrate is adhered to the urn using adhesive. The substrate according to the present invention may be transparent. Moreover, the decorative graphic may be printed on the substrate. The substrate is formed from a material selected from the group of polyester, polypropylene, polyethylene, vinyl, acetate, acrylic, polystyrene, or polycarbonate.

According to yet another embodiment of the invention, the substrate is adhered to the urn using transparent adhesive.

The burial vault or its carapace is customized by cleaning a top surface thereof; providing a substrate having a decorative graphic image printed on one side and an adhesive layer covered by a backing sheet on an opposite side; peeling the backing sheet from one end of the substrate; saturating the adhesive side of the substrate with a soap solution; inverting the substrate so that the adhesive side is facing the top surface of the carapace and aligning the substrate with the carapace; placing the substrate in contact with the surface of the carapace; removing the soap solution entrapped between the carapace and the substrate; and allowing the adhesive to dry.

BRIEF DESCRIPTION OF THE DRAWINGS

The above mentioned embodiments of the invention will be better understood by reference to the following description of embodiments of the invention taken in conjunction with the accompanying drawings, wherein.

DETAILED DESCRIPTION

To date, a lot of attention has been focused on the aesthetic appearance of a funeral casket. Caskets are made from a wide variety of materials with an even wider selection of finishes. However, little attention has been paid to the burial vault. In the U.S. many cemeteries require that the casket be placed within a burial vault to minimize the settling of the topsoil. The lack of attention to the cosmetic (aesthetic) appearance of the burial vault has been due to the fact that the main portion of the vault is concealed from view within the earth by the time the mourners arrive to the graveside. Notably, the body of the vault is typically already placed within the grave before the mourners arrive. During burial, the casket is placed in the burial vault, the carapace is placed on top of the vault, and soil is shoveled on top of the carapace. The carapace is typically an unadorned, utilitarian object. The inventors of the present invention have identified a long-felt, unmet need to customize the carapace and enhance its aesthetic qualities.

Figure 1A:
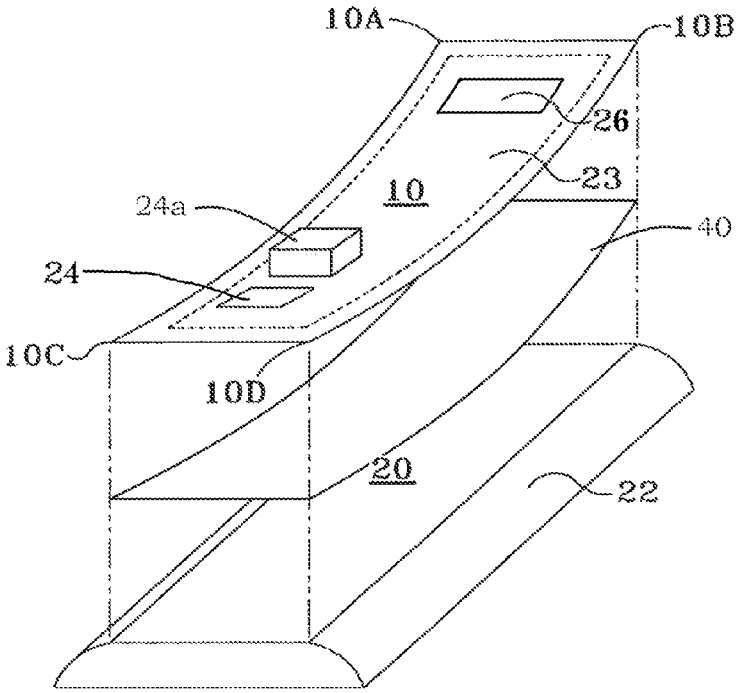
FIG. 1A is an exploded view of the decorative burial vault according to an embodiment of the invention.

FIG. 1A shows a first embodiment of the invention in which a decorative substrate 10 is applied to a top exterior surface 20 of carapace 22. The customization of the carapace 22 is accomplished through the use of a graphic 12 printed onto the substrate which is applied to the exterior surface of the carapace 22. According to a preferred embodiment the graphic 12 is a full sized color graphic image which generally spans the surface of carapace.

Figure 1D:
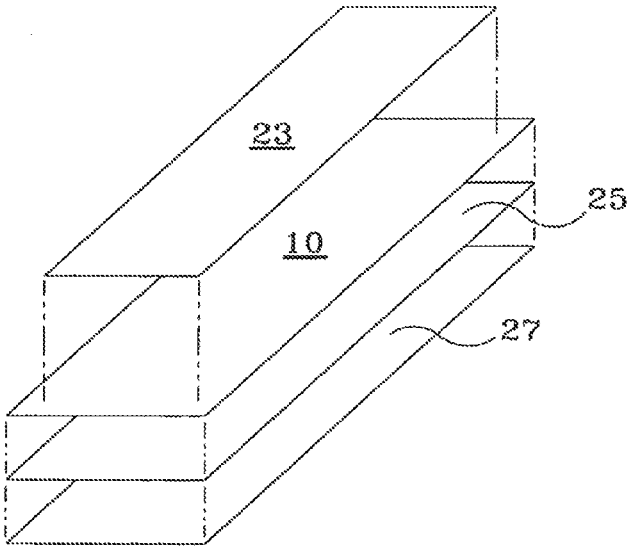
FIG. 1D is an exploded view showing the optional protective layer, adhesive and backing sheet applied to the substrate.
Figure 1B:
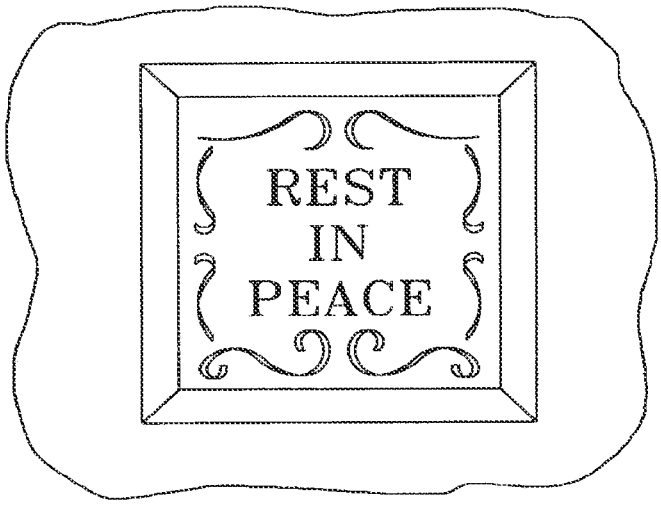
FIGS. 1B-1C show a graphic image printed on the substrate.
Figure 1C:
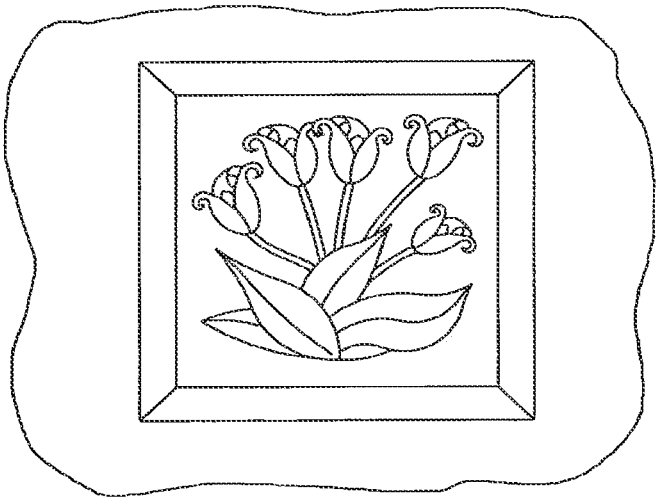

FIGS. 1C and 1D show the substrate 10 with a graphic image 12. Although not depicted in the drawings, the use of a color graphic image is preferred.

The substrate 10 is relatively large, typically 20-30 inches wide by 70-80 inches long. According to a presently preferred embodiment, graphic image 12 is printed onto the substrate 10. Good results may be achieved by using a Scitex Superjet printer manufactured by Aprion Digital Ltd., 14 Hamada St., Herzlia B 46104, Israel. However, any printer capable of printing on a large format substrate is acceptable. For example, good results may be achieved using a Hewlett Packard HP 5500 series printer.

The graphic 12 is printed in onto the substrate 10 which in turn may be adhered to the carapace 22. According to an embodiment in which there is no carapace 22, the substrate may be applied directly onto a surface of the burial vault itself, which is typically a concrete surface, but can be formed of any suitable material. When applying the substrate directly to concrete, for example, the substrate can be melted on to maximize adhesion.

An optional protective layer 23 may be applied to the upper surface of the substrate 10 to protect the graphic image 12 from being soiled. The substrate 10 is sized to substantially span the entire top surface 20 of the carapace 22. Preferably, the substrate 10 is formed as a single continuous sheet of material because the presence of seams detracts from the aesthetic quality. The substrate 10 may be formed of a variety of materials including polyester, polypropylene, polyethylene, vinyl, acetate, acrylic, polystyrene, or polycarbonate. According to a preferred embodiment the substrate 10 is formed from a polyester material which is both transparent and flexible. However, the substrate may be formed of a rigid or semi-rigid material. Moreover, an opaque substrate is also acceptable.

As will be appreciated by one of ordinary skill in the art, a wide variety of adhesives may be used to mount the substrate 10 onto the carapace 22. If the substrate 10 is transparent then it is preferable that the adhesive be completely colorless and transparent as well. According to a preferred embodiment, a thin coating of adhesive 25 is applied to a back surface of the substrate 10 and a non-stick backing sheet 27 is applied to cover the adhesive. Preferably, the adhesive is applied to the unadorned substrate by the manufacturer of the substrate.

As will be appreciated, the aesthetic appearance of the decorated carapace is of the utmost importance. To prevent air bubbles and the entrapment of foreign articles which would mar the appearance of the graphic image, it is necessary to prepare the surface 20 of the carapace 22 to receive the substrate 10.

Figure 2:
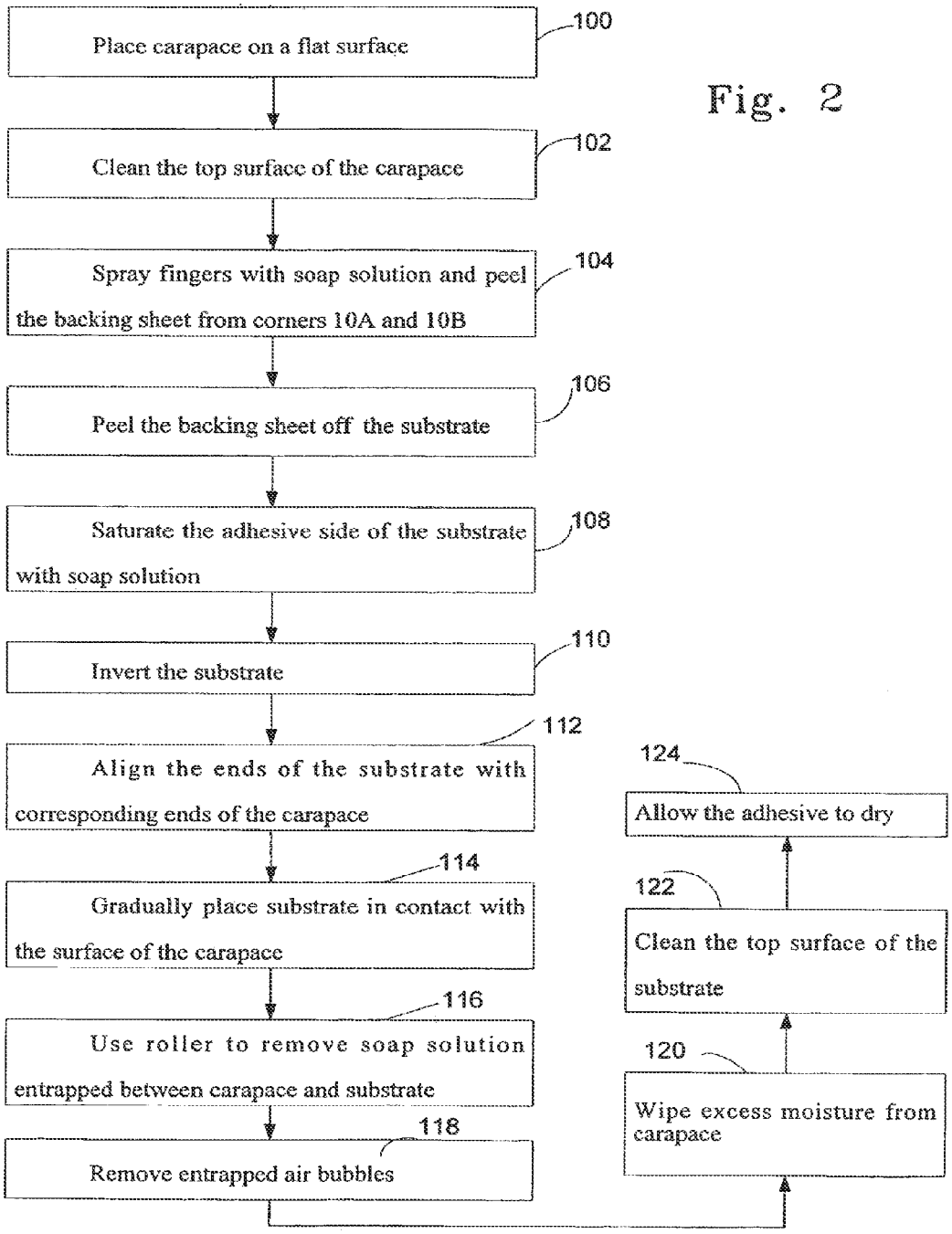
FIG. 2 is a flow diagram of the method for applying the substrate to the carapace.

FIG. 2 is a flowchart of the process used to attach the substrate 10 to the carapace 22. The method steps according to an embodiment may be described as follows. Place carapace 22 on a flat, rigid surface as support so that when pressure is applied the carapace does not bend and remove the optional protective film (not illustrated), if present, from the carapace 22 (step 100). The Clean the top surface 20 of the carapace 22 using a roller (step 102). Clean the roller as needed to remove lint and the like using tack sheets. A tack sheet can be used more than once. Dust particles, which are not removed, will appear as blemishes under the image when it is fully dried. Spray your fingers with an application solution to prevent leaving finger prints on the substrate and peel the backing sheet 27 from comers 10A and 10B of the substrate 10 (step 104). See FIG. 1. There are numerous commercially available application solutions which provide satisfactory results. One such solution is Rapid Tac application fluid manufactured by Rapid TAC Inc, 186 Combs Drive, Merlin Oreg. 97532. Moreover, Applicant has found that a solution formed by mixing 3 teaspoons "Ultra Dawn" dish soap with 12 oz. distilled water also provides satisfactory results. Hereinafter reference to soap solution should be understood to refer to application fluid.

To assist in separating the substrate 10 from backing sheet 27, tape may be placed on the substrate 10 and on the backing sheet 27 proximate corner 10A. Pull the ends of the tape in opposite directions and the backing sheet 27 should separate easily from the substrate 10. Gradually remove the backing sheet 27 from the substrate 10 (step 106). This task is more easily accomplished using two people. With one person holding comers 10A and 10B, a second person should peel the backing sheet 27 off of the substrate 10. The substrate 10 should be upside down (adhesive layer 25 facing up) on top of the carapace 22. Spray (saturate) the adhesive side of the substrate 10 with the soap solution (step 108). Lift the substrate 10 off of the surface of the carapace 22, and invert the substrate 10 so that the adhesive side 25 is facing the top surface 20 of the carapace 22 (step 110). Once again this task is most easily accomplished using two people. One person should lift the substrate 10 off carapace 22 holding corner 10A and a second person holding corner 10C; saturate the surface 20 of carapace 22 with approximately 2 oz. of soap solution.

To place the substrate 10 on the carapace 22, one person should hold comers 10A and 10B while the other holds comers 10C and 10D in the air. Align the ends of the substrate 10 with the corresponding ends of the carapace 22 (step 112). The edge of the substrate 10 on side 10A, 10B should be placed approximately 1/16" to 1/8" from the edge of the carapace 22.

Once corners 10A, 10B are aligned with the edge of the carapace 22, have the person who is holding corners 10C and 10D lay their side down on the carapace 22. Gradually place the substrate 10 in contact with the surface of the carapace (step 114) working lengthwise starting from comers 10C, 10D and ending in corners 10A, 10B. Remove the soap solution entrapped between the carapace 22 and the substrate 10 using the roller (step 116). Use light roller pressure and start from the center of the substrate and work toward the ends lengthwise. Repeat as needed to remove as much solution as possible using firm roller pressure, being sure to work toward the ends lengthwise from the center of the substrate.

Using a squeegee and beginning in the middle of the carapace (10E, 10F), apply firm pressure to remove entrapped air bubbles and any remaining solution (step 118). After the squeegee process is complete, use a soft cloth to wipe excess moisture from the top and sides of the carapace 22 (step 120). Remove the protective film 23, if present, from the substrate 10 and discard. Clean the top surface of the substrate 22 using ammonia free Windex or the like (step 122). Allow the adhesive to dry (step 124).

Figure 3:
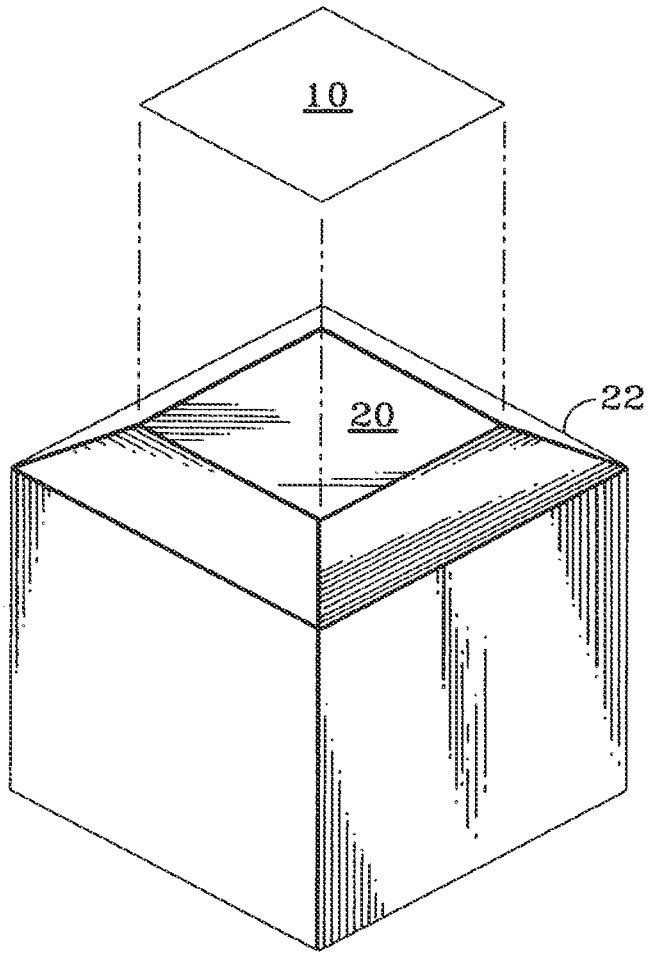
FIG. 3 shows the substrate applied to the carapace of an urn vault.

According to a further embodiment of the invention, the substrate may be applied to the carapace of a smaller vault (FIG. 3) used to intern an urn containing the remains of the deceased. FIG. 3 depicts the substrate being applied to the top surface 20 of the urn vault 22.

Figure 4:
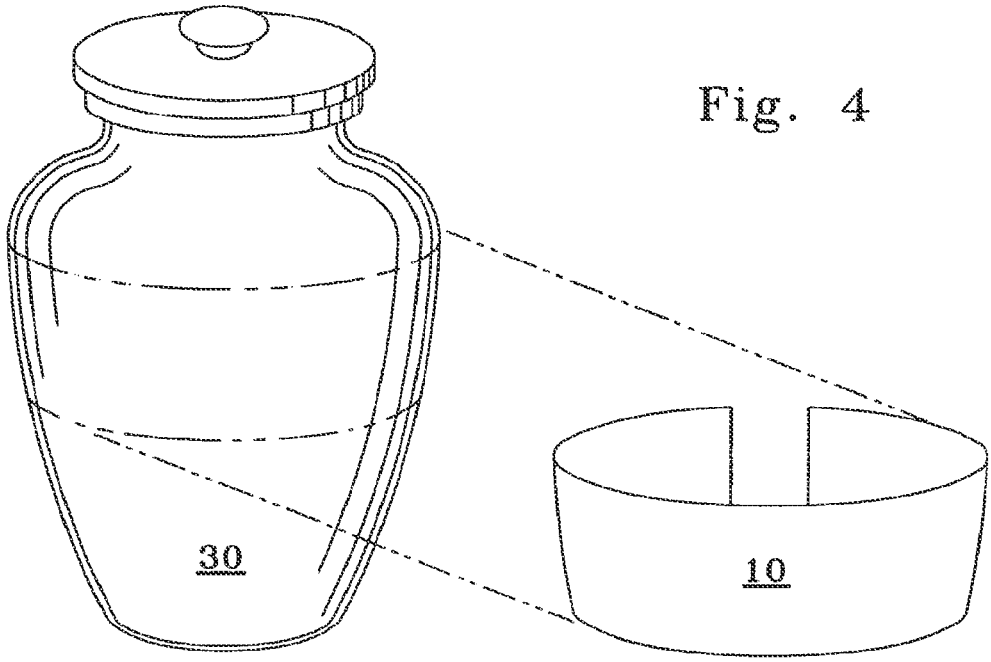
FIGS. 4 and 5 show the substrate applied to an urn.
Figure 5:
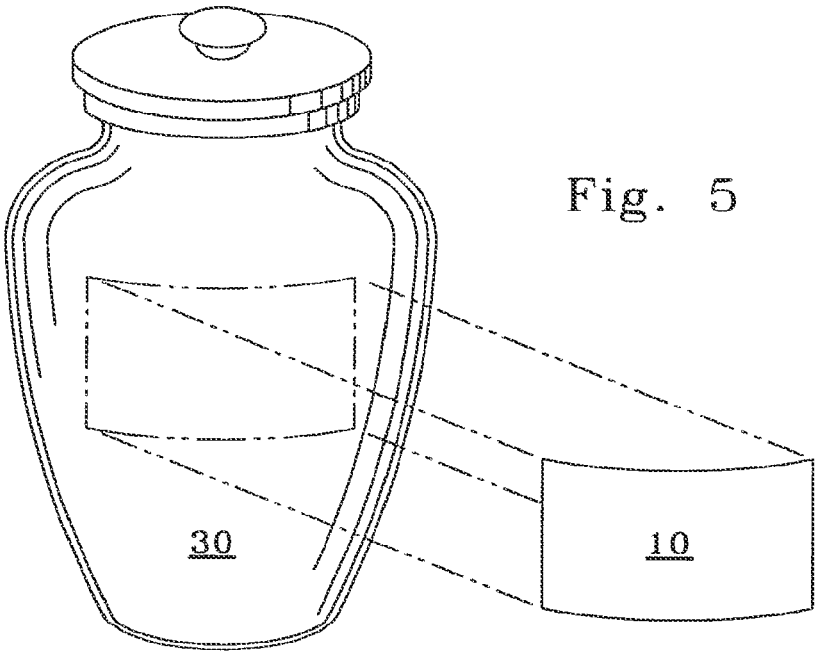

FIGS. 4 and 5 depict a further embodiment of the present invention in which the substrate 10 is used to customize the appearance of a burial urn 30. Urn 30 is customized by selecting a graphic from a library of images, printing the graphic 12 on a substrate 10, and applying the substrate 10 to a surface of the urn 30. In FIG. 4, the substrate 10 substantially spans a circumference of the urn 30, whereas in FIG. 5 the substrate covers only a portion of the urn 30.

In a further embodiment, the substrate or burial vault may contain a Quick Response (QR) Code®, which is an industry standard type of matrix/2D machine-readable barcode. In a preferred embodiment, the QR Code will contain a link to a website that contains information about the deceased, such as obituary information and/or a memorial page with text, photos, video, and other information, such as friends comments and the like. The addition of the QR Code permits those friends and family attending the funeral to photograph the burial vault and thus obtain immediate access to the relevant information about the deceased, and to retain the information after graveside services. Also, this allows users of smart phones to share or view content on popular social sites such as Facebook or Twitter after they leave the burial or if they are unable to attend graveside services to be able to view it.

In a further embodiment, the adhesive is a removable adhesive characterized by low ultimate adhesion and clean removability, and also possibly a repositionable adhesive that allows for removal and reapplication of the substrate. When such an adhesive is utilized, it allows family or friends to remove the substrate from the burial vault and take it home with them. This allows the product to be repositioned and adhered to a display area where the family would like (such as walls, doors or frames etc.). The removable adhesive is defined herein as being of such a strength that the substrate can be easily removed without damage.

A carrier sheet may be provided to loved ones who remove a removable portion so that the removable portion can be transported without acquiring contaminants on the adhesive during transport or storage. The carrier sheet is preferably sturdy enough to prevent folding or other damaging bending from occurring, although the carrier sheet could be somewhat flexible (e.g., to allow storage in a carrier tube). A more rigid carrier sheet can be provided if it is intended that the removable portion of the substrate remain flat. The carrier sheet should be made of a material, such as plastic, that allows the removable portion to be readily separable without damage so that this portion can be reapplied elsewhere. The carrier sheet can be run through the printing process so that a logo or other form of advertisement can be added.

The removable and repositionable adhesive allows for different shapes to be die cut in and part of the substrate 26 to be taken home and repositioned to a wall, door, window, refrigerator, or to be framed, or otherwise preserved for display or kept as a keepsake. This also can be accomplished with a fabric for a canvas wrap to be made with the substrate after the graveside service.

One possible issue that may result when a removable portion is removed is that the removal exposes the underlying carapace or possibly even a vault surface, such as concrete, if no carapace is present, making a somewhat unsightly appearance. Thus, a lower substrate layer 40 may be provided between the substrate and the carapace or burial vault surface that is exposed when the removable portion of the substrate is removed. This lower substrate layer could cover the entire surface area of the substrate, or it could only cover the areas for which the removable portion will be removed.

Furthermore, the lower substrate layer could contain the same image as the substrate layer, or it could contain a solid color or other feature that blends in with the substrate design to lessen the visual impact of removing the removable portion. For example, the underlying image on the lower substrate layer could continue with an image of an American flag that forms the primary image, but without the loved one's portrait on it. When a lower substrate layer is used, it is possible that the lower substrate layer comprises the primary image, such as the American flag, and the substrate is mostly clear, allowing the primary image to show through, while the removable regions do not have to be clear and contain imagery, decorations, text, etc. personalized to the deceased.

The substrate should be designed with an adhesive that is readily removable when applied to the lower substrate. The lower substrate adhesive should be designed to adhere more strongly to the carapace or burial vault surface to which it is applied than the substrate adhesive when applied to the lower substrate, which prevents it from becoming separated when the removable portion of the substrate is removed. A surfactant can be applied to the substrate and/or the lower substrate layers as well as the removable portions to assist in precise placement when the layers are applied. Edges may be utilized for precise alignment, although it is also possible to utilized other forms of alignment marks.

The arrangement of the removable portions can be located at ends of the substrate or can be provided at interior portions of the substrate, and can, in an embodiment, be arranged in a symmetrical manner, such symmetry being symmetrical about a horizontal or vertical axis, or can be radial symmetry. This can help achieve a balanced artistic form. However, this is not necessary, and, according to an embodiment, larger elements having no symmetry, such as clouds and the like for children can be included.

Loved ones of the deceased can select a primary image from a form template collection, and can also select possible removable overlay arrangements from a collection as well. The loved ones can then provide pictures or other images, text, or other forms of personalized decorations that are utilized in the substrate.

According to an embodiment, the substrate can be created utilizing 3D printing technology to form textures, shaping, or objects on/within the substrate. The 3D printing can be utilized regardless of whether the substrate has removable portions or not—however, in an embodiment, the 3D printing can create actual 3D objects 24*a* that can be removed and kept as keepsakes by loved ones. For example, if the deceased was an avid baseball player or fan, 3D baseballs could be provided on the substrate. If the baseballs, or other objects, are designed to be removable, then loved ones can take them home after the graveside service. Thus, the decorative 3-D printed element may be a removable element 24*a* that has a removable adhesive layer interposed between it and the top surface so that the 3-D printed element can be removed from the top layer without damage.

The scope of the invention is not limited to the specific embodiments described herein. One of ordinary skill in the art will appreciate that changes may be made without departing from the scope and spirit of the invention.

We claim:

1. A decorative burial vault for receiving a casket therein, the decorative burial vault comprising:

a top surface;

a lower substrate that is affixed to the top surface with an adhesive layer interposed between the top surface and the lower substrate;

a substrate, having a decorative graphic, that is removably attached to a top surface of the lower substrate with removable adhesive interposed between the substrate and the lower substrate, and adhering the substrate to the lower substrate, wherein the removable adhesive permits separability with less force than the adhesive layer.

2. The decorative burial vault according to claim 1, further comprising:

a carapace that is affixed to the burial vault, and wherein the top surface is a top surface of the carapace.

3. The decorative burial vault according to claim 1, wherein the substrate further comprises a removable die cut portion, wherein the removable die cut portion is easily removable from the remainder of the substrate after application of the substrate to the top surface without damage and is repositionable and adheres to a different location, thereby providing a keepsake.

4. A decorative burial vault for receiving a casket therein, the decorative burial vault comprising:

a top surface;

a lower substrate that is affixed to the top surface with an adhesive layer interposed between the top surface and the lower substrate;

a substrate, having a decorative 3-D printed element printed thereon, that is removably attached to a top surface of the lower substrate with removable adhesive interposed between the substrate and the lower substrate, and adhering the substrate to the lower substrate, wherein the removable adhesive permits separability with less force than the adhesive layer.

5. The decorative burial vault according to claim 4, wherein the decorative 3-D printed element is a removable element that has a removable adhesive layer interposed between it and the substrate so that the 3-D printed element can be removed from the substrate top layer without damage.

* * * * *